United States Patent [19]

Carlson et al.

[11] 4,242,655

[45] Dec. 30, 1980

[54] RF CONNECTOR ASSEMBLY WITH LOW FREQUENCY ISOLATION

[75] Inventors: David J. Carlson; John P. Yu, both of Indianapolis, Ind.

[73] Assignee: RCA Corporation, New York, N.Y.

[21] Appl. No.: 969,781

[22] Filed: Dec. 15, 1978

[51] Int. Cl.[3] ..... H01R 17/10

[52] U.S. Cl. ..... 333/183; 333/260

[58] Field of Search ..... 333/182, 183, 260; 339/147 P, 147 R

[56] References Cited

U.S. PATENT DOCUMENTS

| | | | |
|---|---|---|---|
| 3,023,383 | 2/1962 | Schlicke | 333/182 |
| 3,447,104 | 5/1969 | Schor | 333/183 |
| 3,539,973 | 11/1970 | Antes et al. | 333/182 |

*Primary Examiner*—David K. Moore

*Attorney, Agent, or Firm*—E. M. Whitacre; J. S. Tripoli

[57] ABSTRACT

A coaxial RF connector adapted for mounting on a wall of a utilization device, such as a video disc player, employs a capacitor for providing DC and low frequency blocking between the wall of the device and the outer conductor of the connector. The capacitor is formed in the shape of a washer to provide a uniformly distributed capacitance around the outer conductor.

7 Claims, 3 Drawing Figures

RF CONNECTOR ASSEMBLY WITH LOW FREQUENCY ISOLATION

The present invention relates generally to RF connectors and more particularly to RF connectors having DC and low frequency isolation.

There are many devices available for connecting to a television receiver. The receiver functions as the display device for the particular device under consideration. One such device is the video disc player. Whenever a video disc player is connected to a TV receiver, there is concern that if a fault in the TV receiver occurs, DC or low frequency currents will be flowing from the TV receiver back to the video disc player and will cause either damage to the player, or will even represent a shock hazard for the user of the video disc player.

Typically, the device associated with the TV receiver is connected from an output connector on the device to a connector on the TV receiver via a coaxial cable. If the TV receiver chassis becomes hot, the DC or low frequency current may be conducted via the output connector from the TV receiver over the coaxial cable and into th device, such as the video disc player, via its connector.

In the prior art, attempts have been made to reduce the problems associated with the conduction of low frequency or DC currents from one device to another by attaching a lump element capacitor from the outer conductor of the coaxial cable to a point representing the chassis ground of the system. The problem experienced with this form of protection is that the lumped element includes a given length of wire leads which must be connected into the system and these leads represent an inductive element which could very well radiate RF energy during system operation. The radiation from the inductive leads could possibly cause interference with the displayed image of the system and cause the device to exceed the strict limits or permissible levels of radiation for this class of devices. The present invention is directed toward an RF connector which is useful for providing DC and low frequency isolation between two devices connected as described above without introducing inductive components from added leads.

In accordance with the present invention an RF connector assembly is provided for the device to be protected. The assembly has an inner electrical conductor and an outer electrical conductor, which is defined by a tube-like housing. The housing is made coaxial with the inner conductor. The assembly comprises a means adapted for securing the tube-like housing to a wall of the utilization device. In addition, the assembly comprises a means for providing a uniformly distributed capacitance. The capacitance is adapted for providing electrical signal connection between the housing and the wall of the utilization device for blocking the flow of DC and low frequency currents therebetween.

Although the present invention will be described herein in the context of an RF connector assembly attached to a video disc player, it will be appreciated that an RF connector in accordance with the principles embodied in this invention is equally useful in the coxtext of many other devices, such as video games, video tape recorders and video data terminals which are intended for connection to a device such as a television receiver. This RF connection will be useful for any device where there is the possibility of conducting DC currents or low frequency currents from one device to another via a coaxial interconnection.

Figure 1:
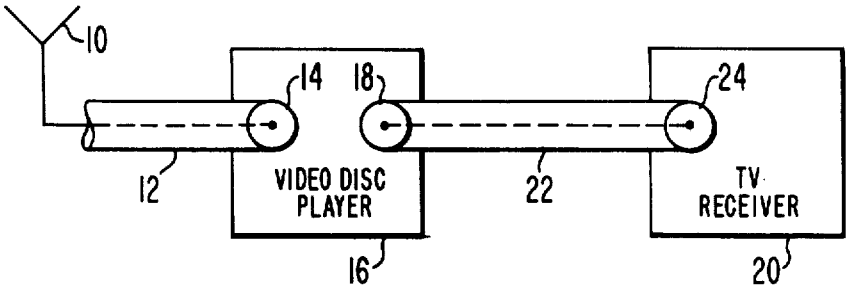
FIG. 1 is a block diagram to illustrate the location of the RF connectors in accordance with the present invention.

Referring now to FIG. 1, an antenna 10 is connected via an RF cable 12 to an RF connector 14 which is typically located on the back chassis wall of a video disc player 16. Typically, the cable 12 is a coaxial cable. In this case, it would be desirable to have the RF connector 14 built in accordance with the principles of the present invention. If a twin lead cable is used in place of coaxial cable 12, then some other form of connector would be used in place of the RF connector 14, or alternatively, an adapted could be used to go from twin lead to a coaxial cable.

Another RF connector 18, which is coaxial in form, is used for connecting the video disc player 16 to a television receiver 20 via an RF cable 22. In this case, cable 22 is a coaxial cable for coupling RF signals from connector 18 to connector 24 which is located on the back panel of the television receiver 20.

The video disc player 16 is arranged such that when it is operative, that is, when a record is being played back and displayed on the TV receiver 20, the signals picked up by antenna 10 and coupled to the video disc player 16 are coupled to a dummy load within the video disc player. In this way, off-the-air broadcast signals are prevented from reaching the TV receiver 20. Conversely, when the video disc player is switched off, a mechanism, which is provided within the player 16, permits the off-the-air signals picked up by antenna 10 to be coupled through the video disc player and into the TV receiver via coaxial cable 22.

Figure 2:
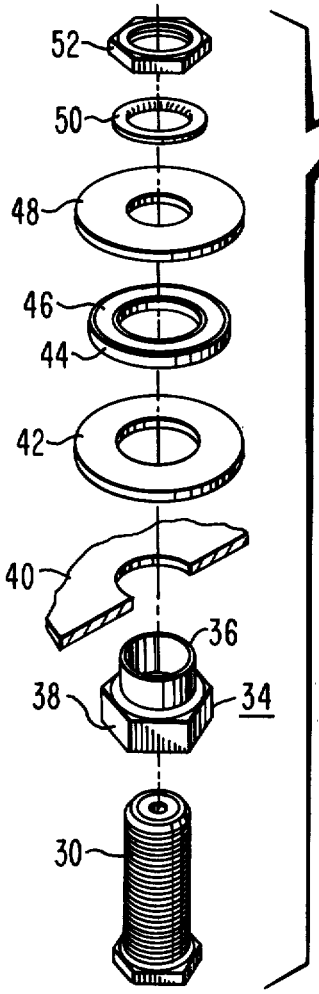
FIG. 2 is an assembly drawing of the components of an RF connector in accordance with the principles of the present invention.

Referring now to FIG. 2, the RF connector assembly comprises an outer conductor in the form of a tube-like housing 30 which is made from a conductive metal such as cast iron or cadmium plated brass. An inner conductor 32 is coaxial with the tube-like housing 30. An insulating bushing 34 is also provided and is arranged to fit over the tube-like housing 30. The insulating bushing 34 includes a sleeve member 36 and a nut-like member 38. The lower nut-like portion 38 of the insulating bushing 34 is adapted to receive the nut portion of the outer conductor 30. This arrangement, when connected together in the final assembly, prevents the rotation of the tube-like housing with respect to the insulating bushing 34.

The outer conductor 30 is inserted through the insulating bushing 34 and the sleeve portion 36 of bushing 34, and the sleeve 36 is adapted to pass through an opening in the chassis wall shown in FIG. 2 as 40. When assembled, of course, the tube-like outer conductor 30, which is a threaded member, will extend substantially through the bushing 34 and the hole in the metal chassis wall 40. The shoulder of bushing 34 at the base of the sleeve portion 36 is made to bear upon a major surface of the metal chassis wall 40. On the other side of the chassis wall 40 a flat washer 42 is located and is adapted for sliding over the sleeve portion 36 of the insulating bushing 34. Thus, the washer 42 is in electrical contact with the other surface of the metal chassis 40 but is insulated from the outer conductor 30 of the tube-like housing.

On the other side of washer 42 is located a washer-like capacitor 44. Capacitor 44 is typically a ceramic type capacitor having an electrically conductive material 46 deposited upon each of the major flat surfaces thereof. Capacitor 44 is thus completely symmetrical. The center hole in this washer-like capacitor 44 is made large enough to fit over at least a portion of the sleeve element 36 of the insulator 34. That is, the diameter of the hole in the capacitor 44 is larger than the outer diameter of the sleeve portion 36 of bushing 34. The dimension of capacitor 44 in the axial direction is selected so that the sleeve portion 36 of bushing 34 does not extend all the way through the washer-like capacitor 44 in the final assembly. On the other side of capacitor 44, there is shown anothr flat washer which is electrically conductive and is designated as 48. It will now be seen that when assembled, capacitor 44 is in effect sandwiched between the washers 42 and 48. Again, it will be noted that there is an electrical connection between washer 48 and the electrically conducting material 46 (forming one electrode of the capacitor) on one side of washer 44 and similarly there is an electrical connection between the electrically conducting material on the other side of capacitor 44 (forming the other capacitor electrode) and washer 42. Thus, capacitor 44 forms a uniformly distributed capacitance between the outer conductor 30 and the chassis wall 40.

Completing the RF connector assembly is a lock washer 50 and a nut 52. Lock washer 50 is adapted to fit over the tube-like housing 30 and then the nut 52 is threaded onto the tube 30.

Figure 3:
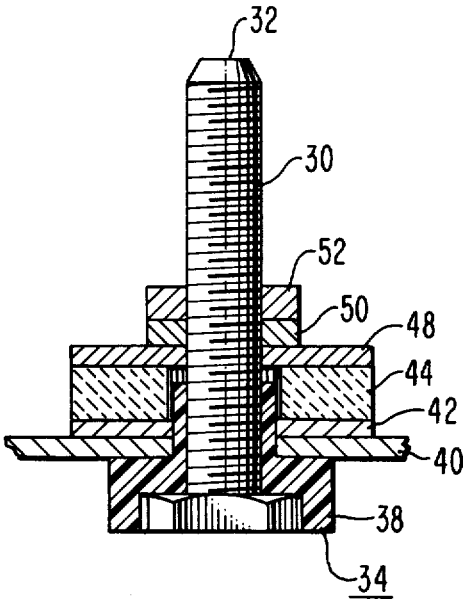
FIG. 3 is a sectional view of the RF connector shown in FIG. 2.

In FIG. 3, elements common to FIG. 2 have like designations. In the sectional view of FIG. 3, the manner in which the nut-like portion 38 of bushing 34 captures the nut portion of outer conductor 30 is clearly shown. In addition, the relative position of the capacitor 44 with respect to the sleeve portion 36 of bushing 34 is also shown. Sleeve portion 36 is dimensioned in the axial direction relative to capacitor 44 so as to insure a solid electrical connection between the washer 48 and the electrode 46 of capacitor 44.

The inclusion of the washer-like ceramic capacitor 44 in the RF connector assembly provides a high impedance path for DC and low frequency currents, and at the same time provides a low impedance path for RF current between the outer conductor 30 of the assembly and the chassis 40. The circular shape of capacitor 44, with its deposited electrodes, is designed to provide an equally distributed capacitive impedance around the complete circumference of the connector. When used in an RF connector assembly as described above, the capacitive impedance represented by capacitor 44 between the outer conductor 30 and the metal chassis 40 is essentially free of parasitic inductive and resistive components.

Typically, the washer-like capacitor 44 is made from a ceramic material and has a size which will provide about 1800 picofarads of capacitance. This size capacitor will represent a low impedance at 60 MHz, which is at or near the frequency of the low VHF TV channel carriers such as channels 2 and 3, while still providing DC and low frequency current blocking.

We claim:

1. An RF connector assembly adapted for use with a utilization device, said assembly having an inner electrical conductor, and, an outer electrical conductor defined by a tube-like housing, said housing being coaxial with said inner conductor, said assembly comprising:

means adapted for securing said housing to a wall of said utilization device; insulative means fitted over said housing; and means for providing a uniformly distributed capacitance between said housing and said wall for blocking the flow of DC currents therebetween.

2. The assembly according to claim 1 wherein said means for providing a uniformly distributed capacitance comprises a washer-like capacitance element.

3. The assembly according to claim 2 wherein said capacitor includes an electrically conductive material disposed on a first major surface of said capacitor and an electrically conductive material disposed on a second major surface of said capacitor.

4. An RF connector assembly adapted for use with a utilization device, said assembly having an inner electrical conductor, and an outer electrical conductor defined by a tube-like housing, said housing being coaxial with said inner conductor, said assembly comprising:

means adapted for securing said housing to a conductive wall of said utilization device, said securing means including an insulating sleeve fitted over said housing and having a surface adapted for bearing against a first surface of said wall; and a washer-like capacitive element fitted over said housing and at least a portion of said sleeve, said capacitive element having a first major surface adapted for electrical contact with another surface of said wall, said capacitive element blocking the flow of DC currents between said tube-like housing and said wall.

5. The assembly according to claim 4 wherein said capacitive element comprises a washer-like ceramic material having a conductive coating on said first major flat surface forming a first electrode and a conductive coating on a second major flat surface forming a second electrode.

6. The assembly according to claim 5 wherein said housing is threaded and wherein said securing means further comprises a nut and a conductive washer assembly, a major flat surface of said conductive washer bearing against said capacitive element second major surface when said nut is tightened down on said threaded housing.

7. An RF connector assembly adapted for use with a utilization device, said assembly having an inner conductor, and, an outer electrical conductor defined by a tube-like housing, said housing being coaxial with said inner conductor, and being threaded along the axial direction, said assembly being adapted for mounting on a wall of said utilization device through a hole in said wall; said assembly comprising:

an insulating bushing having a sleeve member fitted over at last a portion of said tube-like housing; said bushing having a surface disposed perpendicularly with respect to said axial direction adapted for bearing upon one side of said wall, said member being adapted for passing through said hole;

a ceramic capacitor formed in the shape of a washer and having conductive material on first and second major flat surfaces thereof, said washer shaped capacitor having a center hole with a diameter sufficient to fit said capacitor over said housing and said sleeve member, said conductive material on said first flat surface of said capacitor being adapted for electrical contact with the other side of said wall;

a conductive washer having a center hole sufficient for fitting over said housing, said conductive washer being brought into electrical contact with said conductive coating on said second flat surface of said capacitor;

a lock washer having a center hole sufficient for fitting over said housing, said lock washer bearing against said conductive washer;

a nut threaded onto said housing and bearing upon said lock washer, said nut adapted for securing said assembly to said wall when tightened.

* * * * *